US006569381B2

(12) United States Patent
Le Floc'h et al.

(10) Patent No.: US 6,569,381 B2
(45) Date of Patent: May 27, 2003

(54) PROCESS FOR MANUFACTURING THIN TIN/TUNGSTEN COMPOSITE ELEMENTS

(75) Inventors: Alain Le Floc'h, Valbonne (FR); Jean-Michel Tauzia, Blanquefort (FR)

(73) Assignee: SNPE, Paris (FR)

( * ) Notice: Subject to any disclaimer, the term of this patent is extended or adjusted under 35 U.S.C. 154(b) by 0 days.

(21) Appl. No.: 09/837,208

(22) Filed: Apr. 19, 2001

(65) Prior Publication Data

US 2001/0053331 A1 Dec. 20, 2001

(30) Foreign Application Priority Data

May 10, 2000 (FR) ..... 00 05930

(51) Int. Cl.[7] ..... B22F 3/00
(52) U.S. Cl. ..... 419/67
(58) Field of Search ..... 419/67

(56) References Cited

U.S. PATENT DOCUMENTS 5,399,187 A 3/1995 Mravic et al.
5,877,437 A 3/1999 Oltrogge
5,950,064 A 9/1999 Robinson et al.
5,963,776 A * 10/1999 Lowden et al. ..... 419/64
6,174,494 B1 * 1/2001 Lowden et al. ..... 419/66
6,248,150 B1 * 6/2001 Amick ..... 75/248

* cited by examiner

*Primary Examiner*—Ngoclan Mai
(74) *Attorney, Agent, or Firm*—Oliff & Berridge, PLC

(57) ABSTRACT

The subject of the invention is a particularly simple and inexpensive process for manufacturing tin/tungsten composite elements having a thickness of between 1 mm and 6 mm, such as spherical shot for hunting cartridges or fishing sinkers, from a tin/tungsten powder blend. The powder blend is extruded, in the solid state, directly into a wire whose thickness is between 1 mm and 6 mm with an extrusion rate≦80 mm/s. Next, the wire is cut into pieces which are then forged to the desired shape, especially into spheres. The subject of the invention is also the aforementioned process for obtaining the wire.

10 Claims, No Drawings

PROCESS FOR MANUFACTURING THIN TIN/TUNGSTEN COMPOSITE ELEMENTS

The present invention essentially relates to the field of hunting and fishing and more specifically the subject of the invention is a novel process for manufacturing thin tin/tungsten composite elements, especially for the manufacture of spherical shot for hunting cartridges or for fishing sinkers.

It is known, in the prior art, to use such non-toxic shot as a replacement for lead shot.

For example, U.S. Pat. No. 5,877,437 describes tin/tungsten composite spherical shot for hunting cartridges, in the form of a malleable tin matrix containing, uniformly distributed within it, tungsten powder as filler.

According to a first process, the shot can be obtained by dispersing tungsten powder in molten tin, and then by forming drops through calibrated openings at the top of a tower. Next, these drops fall through the air or water, making it possible to obtain, by cooling, the spherical shot.

According to a second process, the shot can be obtained by moulding the dispersion of tungsten powder in molten tin, but such a process is very expensive for obtaining shot and is more suitable for obtaining more voluminous projectiles or objects.

Moreover, these melt processes are tricky to implement as it is very difficult to obtain a homogeneous distribution of tungsten powder in the tin matrix, especially because tungsten is not "wetted" by molten tin.

They also have the drawback of resulting in a reduction in the maleability of the tin matrix and the appearance of braising of the tungsten powder, which leads to an undesirable increase in the hardness of the material.

According to a third process, a tin/tungsten powder blend is compacted at high pressure in a mould at a temperature below the melting point of tin.

It is thus possible to produce projectiles weighing several grams (bullets) suitable for rifled, shoulder and hand weapons, but the process is too expensive for obtaining thin elements such as shot.

Moreover, U.S. Pat. No. 5,399,187 describes the production of composite bullets that may consist of a tin matrix filled with tungsten powder.

For matrices made of ductile metal such as tin, the bullets may be obtained by blending metal powders, then by compacting them into bars or billets which are then extruded into wires. The bullets are then obtained by forging wires using punches.

However, it proves to be the case that if it is desired, using a standard technique of drawing tin wires, to wire-draw a strand 10–20 mm in diameter made of tin/tungsten composite in order to reduce the diameter and obtain a wire having a diameter of between 1 and 6 mm, considerable tearing at the tin/tungsten interface and breakage of the wire are observed.

A person skilled in the art therefore seeks a simple and inexpensive process for manufacturing tin/tungsten composite elements of small thickness (1 to 6 mm approximately) such as spherical shot for hunting cartridges or fishing sinkers.

Such a process is the subject of the present invention.

Unexpectedly, it has been discovered that it is possible, by simply extruding a blend of tin and tungsten powders in the solid state, to obtain, directly, without any intermediate wire-drawing and/or bar- or billet-forming step, a wire whose thickness is between 1 mm and 6 mm having satisfactory mechanical integrity, without any tearing at the tin/tungsten interface, provided that the extrusion rate is less than or equal to 80 mm/s.

To obtain the desired composite elements, the wire formed may be cut into portions which are then forged to the desired shape using machines well known to those skilled in the art for providing such a function.

Such a process is particularly simple and inexpensive.

In addition, especially because there is no step of melting the tin, it is possible to retain the maleability of the tin matrix and to obtain a homogeneous distribution of the tungsten powder in the matrix.

According to the invention, the blend of tin powder and tungsten powder is extruded, in the solid state, directly into a wire whose thickness is between 1 mm and 6 mm, preferably between 2 mm and 4 mm, limits inclusive, especially when the cross section of the wire is circular, which is also preferred.

However, the wire may have any cross section, especially an elliptical, square, triangular, rectangular or polygonal cross section.

The term "directly" should be understood to mean that the transition from powder blend to wire takes place without an intermediate step, especially no intermediate step for obtaining billets or strands having a high diameter, for example greater than 8 mm, and without an intermediate wire-drawing operation.

The term "extruded" should be understood to mean, conventionally, that the powder blend is pushed through a die.

The term "solid state" should be understood to mean that the tin/tungsten powder blend is extruded at a temperature below the melting point of tin.

Preferably, the blend is extruded at a temperature of between 170° C. and 225° C., and better still between 190° C. and 220° C., limits inclusive.

According to the process forming the subject-matter of the present invention, tungsten powder and tin powder, the particle size of the powders preferably being in the 1 $\mu$m–200 $\mu$m range, and better still within the 10 $\mu$m–50 $\mu$m range, is firstly blended, in the proportions necessary for achieving the desired density, using a suitable blender.

The tin/tungsten weight ratio is preferably between 0.5 and 2.0, better still between 0.7 and 1.5. Composite elements, especially shot, having a density of between 9 and 12.5 approximately, are obtained.

Next, the powder blend may be extruded either continuously, by uniformly feeding an extruder suitable for this type of operation, or, which is preferable, in a discontinuous manner.

According to this preferred discontinuous version, the powder blend is introduced into the extrusion container (compression chamber) of an extruder which is suitable for this type of operation and which also has, conventionally, one or more calibrated exit (die) nozzles, a piston, the geometry of which is tailored to that of the container, making it possible to push the powder blend through the extrusion die, and a system for heating the extrusion container.

The gauge of the nozzle or nozzles corresponds to the desired cross section of the wire.

According to a particularly preferred version of the invention, the tin/tungsten powder blend is subjected to a partial vacuum before being extruded. To do this, a reduced pressure is created in the extrusion container containing the blend, preferably of less than 100 mmHg using suitable pumping means well known to those skilled in the art.

Thus, better quality wires having a very low porosity, and especially having no air inclusions, are obtained.

As mentioned above, the extrusion rate, measured at the die exit nozzle or nozzles, must be $\leqq$80 mm/s.

If this is not so, a poor surface finish of the wire produced, tearing at the tin/tungsten interface and even wire breakage and/or the appearance of melted particles are observed.

Preferably the extrusion rate is between 1 mm/s and 80 mm/s, better still between 5 mm/s and 60 mm/s.

This limitation of the extrusion rate corresponds to a limitation of the energy supplied during the extrusion. Preferably, the extrusion power developed by the piston of the press is less than 150 W, for example between 10 W and 100 W, better still between 10 W and 70 W, per extrusion nozzle.

According to another preferred version of the invention, the extrusion pressure is between 100 MPa and 300 MPa.

It is also preferable to operate with a ratio of the cross section of the piston to the total cross section of the nozzles, called extrusion ratio, of between 80 and 250.

The speed of the compressing piston is generally less than 0.6 mm/s, preferably between 0.05 mm/s and 0.5 mm/s.

According to another preferred version of the invention, the die does not have a convergent section (flat die) and its land (thickness corresponding to the length of the hole of the nozzle) is preferably between 5 mm and 15 mm.

In order to obtain the desired composite elements, especially spherical shot, the wire obtained is cut into pieces, more particularly cylinders preferably having a length equal to the diameter of the wire, or close to it, and then these elements are forged, preferably at room temperature, in order to obtain the desired shape.

Preferably, and especially according to the preferred version for which the wire pieces are cylinders whose length is close or equal to the diameter of the wire, this forging makes it possible to obtain spheres, or pseudo-spheres which are then ground into spheres, the diameter of which is very close or identical to that of the wire.

Such spherical elements are particularly suitable for producing hunting cartridges or fishing line weights for angling, fly fishing or whip fishing, especially split sinkers.

According to another preferred version, it is possible to obtain, by forging, from cylindrical pieces for example, elements having an ovoid shape and a thickness close to the thickness or the diameter of the wire.

Such ovoid elements are particularly suitable for being used as ballasting bombs for spin fishing or angling with bait, especially split bombs.

All these cutting and forging operations may be carried out continuously, using machines well known to those skilled in the art and especially those used for producing balls for ball bearings.

The thickness of the elements obtained is in general identical or very close to that of the wire.

Depending on the thickness of the wire produced, it is therefore possible to obtain composite elements having a thickness that can vary from about 1 mm to about 6 mm.

The object of the present invention is also the aforementioned process for obtaining the wire, namely a process for obtaining a tin/tungsten composite wire from a tin/tungsten powder blend, characterized in that the powder blend is extruded, in the solid state, directly into a wire whose thickness is between 1 mm and 6 mm and in that the extrusion rate is less than or equal to 80 mm/s.

The aforementioned thin tin/tungsten composite elements may be used for purposes other than the production of hunting cartridges or fishing sinkers, especially, and for example, for producing balancing masses or objects that can act as a screen to ionizing radiation.

Such screens and masses may also be obtained from the wire itself, without this being cut into pieces beforehand.

The following non-limiting examples illustrate the invention and the advantages that it provides.

EXAMPLES 1 TO 6

Manufacture of Spherical Tin/Tungsten Composite Shot According to the Invention, of Various Densities and Particle Sizes The tungsten powder and tin powder used have a medium diameter of about 30 $\mu$m.

The tin and tungsten powders are blended in the proportions mentioned below for each example using a suitable Forberg-type blender, at room temperature (about 20° C.), for about 10 minutes, so as to obtain a homogeneous blend.

Next, the homogeneous blend of the two powders is poured into the container of an extruder. The container, of cylindrical shape, comprises an internal piston of diameter equal to the internal diameter of the container, within the adjustment tolerance, so as to be able to push the blend through the die.

For these examples, two different piston-container diameters (30 mm and 40 mm) were used. This diameter is given below for each example.

The displacement travel of the piston (the working length of the container) is 70 mm.

The rate of displacement of the extrusion piston, driven by a suitable device well known to those skilled in the art, is indicated for each example.

The container is provided, on the one hand, with a device (heating jacket) allowing the powder blend that it contains to be heated and, on the other hand, with a vacuum tap combined with a frit making it possible to establish a reduced pressure in the container filled with the powder blend before extrusion.

The extruder also includes a cylindrical flat die (with no convergent section) having a land (thickness) of 10 mm and provided with a single cylindrical hole located in the central position whose diameter, 2.6 mm or 3.2 mm, is indicated for each example.

The die hole is initially obstructed by an aluminium cover so as to be able to produce a partial vacuum in the container.

The container is then heated and partially evacuated to a reduced pressure of less than 80 mmHg.

After heating to a temperature, mentioned below for each test, and a partial vacuum maintained for about 45 minutes, the powder blend was extruded. The cover closing off the die hole bursts because of the pressure exerted.

The following table gives the operating conditions specific to each example.

| | EXAMPLE No | | | | | |
|---|---|---|---|---|---|---|
| OPERATING CONDITIONS | 1 | 2 | 3 | 4 | 5 | 6 |
| Sn/W ratio by weight | 60/40 | 54.5/45.5 | 54.5/45.5 | 54.5/45.5 | 54.5/45.5 | 54.5/45.5 |
| Theoretical density | 9.70 | 10.18 | 10.18 | 10.18 | 10.18 | 10.18 |
| Diameter of the extrusion piston (mm) | 30 | 40 | 40 | 40 | 40 | 40 |
| Diameter of the die hole (mm) | 3.2 | 2.6 | 2.6 | 3.2 | 3.2 | 3.2 |
| Extrusion ratio | 88 | 237 | 237 | 156 | 156 | 156 |

-continued

| OPERATING CONDITIONS | EXAMPLE No 1 | 2 | 3 | 4 | 5 | 6 |
|---|---|---|---|---|---|---|
| Container temperature (° C.) | 200 | 200 | 215 | 215 | 215 | 215 |
| Speed of the extrusion piston (mm/s) | 0.1 | 0.1 | 0.1 | 0.1 | 0.3 | 0.5 |
| Extrusion rate (mm/s) | 24 | 24 | 24 | 16 | 47 | 78 |
| Extrusion pressure (MPa) | 275 | 259 | 238 | 182 | 172 | 172 |
| Extrusion power (W) | 20 | 33 | 30 | 23 | 65 | 143 |

For all these examples, a wire having the following physical and mechanical properties was obtained:

Density measured by weighing and measuring the dimensions

| | |
|---|---|
| Example 1: | 9.43 |
| Example 2: | 9.69 |
| Example 3: | 9.84 |
| Examples 4 to 6: | not measured. |

The measured densities are close to the theoretical density. The densification is ≧95%.

Metallographic Analyses

They show, for all the examples, an orientation of the elements in the length direction of the wire. Good homogeneity of the tungsten and tin distribution is observed, and there is no or very little inclusion of gas.

The surface finish of the wire, for all the examples, is very satisfactory. However, it is less good for Example 6, while still remaining satisfactory.

Ductility of the Wire

The ductility is determined by the bending angle of the wire (the angle subtended by the two parts of the wire at the moment of breaking).

| | |
|---|---|
| Example 1: | 80° |
| Example 2: | 60° |
| Example 3: | 60° |
| Examples 4 to 6: | not measured. |

This ductility is satisfactory.

Vickers Hardness

This is measured either on a cross section of the wire (transverse hardness) or on a cut piece of the wire in the length direction (longitudinal hardness).

| | | |
|---|---|---|
| Example 1: | 13.52 | (longitudinal) and 13.03 (transverse) |
| Example 2: | 15.07 | (longitudinal) and 14.27 (transverse) |
| Example 3: | 14.87 | (longitudinal) and 15.23 (transverse) |
| Examples 4 to 6: | | not measured |

This hardness is satisfactory.

The wires obtained for these 6 examples were then cut into cylinders, the length of which is equal to the diameter of the wire, using a machine well known to those skilled in the art for carrying out this operation.

Next, the cylinders were forged, at room temperature (about 20° C.) into spheres having a diameter approximately the same as that of the cylinders and of the wire, using a machine also well known to those skilled in the art for carrying out this operation, especially in the field of ball bearings.

Thus, for Examples 1, 4, 5 and 6, the spherical shot obtained had a diameter of about 3.2 mm and, for Examples 2 and 3, the spherical shot had a diameter of about 2.6 mm.

COMPARATIVE EXAMPLES A AND B

These comparative examples do not form part of the invention. They were produced for the sole purpose of showing that the selection of a certain extrusion rate range according to the invention is not arbitrary, but necessary for obtaining the desired technical effect, namely to obtain a wire having a satisfactory surface finish.

Examples 4 to 6 according to the invention were repeated, all other things being the same, modifying the speed of the extrusion piston and therefore, consequently, the expected extrusion rate.

For comparative Example A, an extrusion piston speed of 1 mm/s was imposed. The extrusion pressure measured was 144 MPa.

The extrusion power was 181 W.

The expected extrusion rate was 156 mm/s, but it was found that the wire came out in fragments, which is undesirable.

For Comparative Example B, an extrusion piston speed of 10 mm/s was imposed. The measured extrusion pressure was 255 MPa. The extrusion power was 3200 W.

The expected extrusion rate was 1560 mm/s, but only melted particles appeared.

What is claimed is:

1. Process for manufacturing tin/tungsten composite elements having a thickness of between 1 mm and 6 mm from a tin/tungsten powder blend, comprising:

extruding the tin/tungsten powder blend in the solid state, directly into a wire having a thickness between 1 mm and 6 mm, wherein an extrusion rate less than or equal to 80 mm/s;

cutting the wire into wire pieces; and forging the wire pieces into a desired shape.

2. Process according to claim 1, wherein the wire has a circular cross section with a diameter between 2 mm and 4 mm.

3. Process according to claim 1, wherein extruding the tin/tungsten powder blend is performed at a temperature of between 170° C. and 225° C.

4. Process according to claim 1, further comprising:

subjecting the tin/tungsten powder blend to a partial vacuum before the extruding step.

5. Process according to claim 1, wherein the extruding step is carried out at an extrusion pressure between 100 MPa and 300 MPa.

6. Process according to claim 1, wherein the extruding step is carried out with an extrusion ratio between 80 and 250.

7. Process according to claim 1, wherein the extruding step is carried out at an extrusion power between 10 W and 100 W.

8. Process according to claim 1, the tin/tungsten composite elements comprise spherical shot for hunting cartridges or fishing sinkers.

9. Process for obtaining a tin/tungsten composite wire from a tin/tungsten powder blend, comprising:

extruding the powder blend in the solid state, directly into a wire having a thickness between 1 mm and 6 mm at an extrusion rate less than or equal to 80 mm/s.

10. Process according to claim 2, the tin/tungsten composite elements comprise spherical shot for hunting cartridges or fishing sinkers.

* * * * *